United States Patent [19]

Eskridge et al.

[11] 4,049,766

[45] Sept. 20, 1977

[54] PROCESS FOR IMPROVING CRYSTALLINITY IN NYLON 6

[75] Inventors: Brewster B. Eskridge; Boyce M. Lyon, both of Asheville, N.C.; Eduard H. Boasson, Laag Soeren, Netherlands

[73] Assignee: Akzona Incorporated, Asheville, N.C.

[21] Appl. No.: 648,425

[22] Filed: Jan. 12, 1976

Related U.S. Application Data

[60] Continuation of Ser. No. 530,902, Dec. 9, 1974, abandoned, which is a division of Ser. No. 418,487, Nov. 23, 1973, abandoned, which is a continuation-in-part of Ser. No. 217,839, Jan. 14, 1972, abandoned.

[51] Int. Cl.[2] ..... D01D 5/12

[52] U.S. Cl. ..... 264/210 F; 8/115.6; 8/130.1; 264/290 N; 427/175

[58] Field of Search ..... 264/176 Z, 290 H, 210 F; 427/175; 8/130.1, 115.6

[56] References Cited

U.S. PATENT DOCUMENTS

| | | | |
|---|---|---|---|
| 2,137,235 | 11/1938 | Carothers | 264/176 Z |
| 3,113,369 | 12/1963 | Barrett et al. | 28/75 |
| 3,428,560 | 2/1969 | Olsen | 252/8.7 |
| 3,432,898 | 3/1969 | Stacley et al. | 28/72 |
| 3,433,008 | 3/1969 | Gage | 57/153 |
| 3,513,110 | 5/1970 | Noethe | 264/210 F |
| 3,944,708 | 3/1976 | Dumas | 264/178 F |

FOREIGN PATENT DOCUMENTS

| | | | |
|---|---|---|---|
| 45-36847 | 11/1970 | Japan | 264/178 Z |
| 48-23806 | 7/1973 | Japan | 264/178 Z |

*Primary Examiner*—Jay H. Woo

*Attorney, Agent, or Firm*—Francis W. Young; Jack H. Hall

[57] ABSTRACT

In continuous spin-draw-winding of nylon 6 to produce yarn filaments of mixed beta-alpha crystalline morphology, the improvement wherein prior to drawing, a spin finish emulsion containing from about 0.1 to about 6% by weight of benzyl alcohol is applied to the filaments to enhance conversion of the beta uniformity of dye acceptance to the drawn filaments.

7 Claims, No Drawings

PROCESS FOR IMPROVING CRYSTALLINITY IN NYLON 6

This application is a continuation of co-pending application Ser. No. 530,902 filed Dec. 9, 1974, abandoned which is a division of application Ser. No. 418,487 filed Nov. 23, 1973 abandoned which is a continuation-in-part of application Ser. No. 217,839, filed Jan. 14, 1972 now abandoned.

BACKGROUND OF THE INVENTION

In preparing nylon 6 yarns on a commercial basis, it has been the practice to spin and collect the filaments in a single step operation. In a separate second step, the filaments are drawn and this step may be combined with a third step wherein the drawn filaments are bulked. The resulting yarn products are generally uniform in their dye acceptance and are used in carpets, clothing, etc. The two-stage operation of spinning and subsequently drawing is known in the trade and will be referred to herein as the "split process."

To lower costs and increase the rate of production of nylon 6 yarns, the spinning and drawing steps have been combined so that the filaments are spun, cooled, and drawn in a single continuous operation. While the mechanical processing and handling of the filaments resembles that of the split process, the resulting filaments have been found to vary in dyeability to the extent that carpets and other articles prepared therefrom appear to be "streaky."

The non-uniform dyeability of the filaments is believed to result from the presence of both hexagonal (beta- ) and monoclinic (alpha- ) crystalline forms of nylon 6. In the "as spun" state prior to drawing, the filaments contain large amounts of beta crystallinity, but there is a strong tendency for the beta form to convert to the more thermodynamically stable alpha form. This conversion can be accomplished, for example, by allowing the filaments to stand in the presence of moisture or by subjecting the filaments to relatively high temperatures.

It is believed that conventional split processing produces filaments of relatively uniform dye acceptance because following spinning the filaments are customarily treated with an aqueous-based finish emulsion and are then taken up in package form. The yarn packages are allowed to stand, generally from 6 to 12 hours before the filaments are drawn, and during this time, the aqueous finish emulsion has ample time to penetrate the filaments so that when drawn, the filaments contain a high percentage of alpha crystallinity and appear to dye uniformly.

Because of newer spin-draw-winding processes are continuous and the filaments are not taken up in package form or allowed to stand prior to drawing, there is little opportunity for the finish emulsion to penetrate into the filaments and, as a result, the drawn nylon 6 filaments are believed to consist predominantly of the beta crystalline form. Upon further treatment of the filaments as in bulking and dyeing, the amount of alpha crystallinity is increased and the resulting filaments contain a mixture of alpha and beta forms. Because these forms vary in their ability to accept dyes, the filaments also show a lack of dyeing uniformity.

One method of overcoming the dyeing problem is to treat the filaments at high temperatures (e.g., 200° C.) prior to, and during, drawing. The disadvantages of this technique, however, are that essential elements of the finish emulsion are "fumed" off and the wear factor for various mechanical elements, such as the winding godets, is greatly increased.

What is needed is a method whereby spin-draw-winding of nylon 6 results in a predominantly large amount of alpha crystallinity which promotes relatively uniform dye acceptance. Additionally, to overcome the disadvantages of the prior art, the method must be quick so that it can be used in continuous spin-draw-winding processes and, the method must not require elevated operating temperatures.

DESCRIPTION OF THE INVENTION

In continuous spin-draw-winding of nylon 6, the problems of the prior art are overcome by applying to the filaments, prior to drawing, a spin finish emulsion containing from about 0.1 to about 6% by weight of benzyl alcohol, the maximum based on solubility in the aqueous emulsion. Unexpectedly, it has been found that the resulting drawn filaments exhibit a high degree of alpha crystallinity and tend to dye uniformly so that their use in carpets, clothing, etc., is possible and even preferred.

For example, where nylon 6 filaments are prepared without using the benzyl alcohol, the filaments resulting after spin-draw-winding and bulking generally have a beta/alpha crystallinity ratio of at least 100. In comparison, filaments treated according to the present invention generally have a beta/alpha ratio of less than about 80, and generally in the range of from about 20 to 80.

While benzyl alcohol is the alcohol of choice and to facilitate clarity and convenience, the invention will be described with regard thereto, other low molecular weight alcohols can also be employed as would be apparent to one skilled in the art. The chief requirements in selection of the alcohol are that it not be volatilized under normal processing conditions and that it is compatible with other components of the finish emulsion. Other suitable alcohols include the lower aliphatic (cyclic or alicyclic) and monocyclic aromatic alcohols with boiling points at atmospheric pressure within the range of from about 100° to about 300° C. The alcohols may contain different chemical groups or substituents not interfering to a major extent with the alcoholic nature of the compound. Examples of such alcohols are heptyl alcohol, octyl alcohol, 2-ethyl-1-hexanol, 2-ethyl-1,3-hexanediol, tetrahydrofurfuryl alcohol, 4-methylcyclohexyl-1-methanol, furfuryl alcohol, phenethyl alcohol, 3-phenyl-1-propanol, 2-phenoxyethanol, and monohydroxylated xylenes wherein the hydroxyl moiety is situated on an aliphatic carbon atom.

The use of benzyl alcohol overcomes the difficulties of the prior art in that the alcohol is applied as a component of the finish emulsion (e.g., from 1 to 6%) at normal operating temperatures. Also, the application, as by a conventional stone finish wheel, is relatively fast in that the beneficial action of the alcohol does not require a long period for the polymer to "set up" as in a conventional split process. As will be apparent to one skilled in the art, the components of the finish emulsion other than benzyl alcohol are those conventionally employed. The only requirement in their selection is that they be compatible with the benzyl alcohol.

A representative example illustrating the present invention follows wherein all parts are by weight unless otherwise specified.

EXAMPLE

Unmodified nylon 6 polymer chips having a relative viscosity (R.V.) of 2.40 and a 220° C. melting point were spun to an increase of R.V. to 2.45 and drawn as 1040/68 yarn, which yarn was treated, by a single stone wheel, with an emulsion spin finish containing from 0% to 6% benzyl alcohol. This treated yarn was then drawn at a total ratio of 3.7 to produce a yarn of 15 denier per filament; tenacity and elongation at break were as hereinafter specified in Table I.

TABLE I

DRAWN YARN PHYSICAL PROPERTIES

| % Benzyl Alcohol In Finish | % Benzyl Alcohol In Yarn* | Boiling Water Shrinkage, % | Denier | Tenacity gpd | Elongation at Break |
|---|---|---|---|---|---|
| 0 | 0 | 12 | 1110 | 3.7 | 27 |
| 1 | 0.1 | 12 | 1120 | 3.8 | 27 |
| 2 | 0.2 | 16 | 1100 | 3.9 | 30 |
| 3 | 0.3 | 15 | 1110 | 3.9 | 27 |
| 4 | 0.4 | 15 | 1080 | 4.0 | 26 |
| 6 | 0.7 | 14 | 1100 | 3.9 | 27 |

*Calculation based on finish oil analysis.

The yarn samples of Table I were then bulked by combining two ends and bulking same to give the bulked yarn physical properties, including beta to alpha ratio, as set forth in Table II which follows.

TABLE II

BULKED YARN PHYSICAL PROPERTIES

| Wet Bulk % | Crimps/ Inch | Boiling Water Shrinkage, % | Denier | Tenacity gpd | Elongation at Break | X-Ray Beta/ Alpha |
|---|---|---|---|---|---|---|
| 16 | 16 | 4 | 2580 | 3.1 | 49 | 52 |
| 16 | 16 | 4 | 2550 | 3.3 | 45 | 54 |
| 15 | 14 | 4 | 2600 | 3.3 | 48 | 53 |
| 15 | 11 | 4 | 2620 | 3.3 | 47 | 37 |
| 15 | 11 | 4 | 2610 | 3.3 | 47 | 28 |
| 17 | 12 | 3 | 2640 | 3.2 | 49 | 25 |

The data in the preceding tables shows that benzyl alcohol has little influence on yarn shrinkage, tenacity, elongation, wet bulk, and crimps per inch. An increase in benzyl alcohol generally corresponds to an increase in alpha crystalline content as above illustrated. The use of increased benzyl alcohol content results in an increase in yarn density.

An increase in amount of benzyl alcohol as emulsion component results in an increase in alpha crystallinity, especially within the range of from about 3% to about 6%, and this is reflected in an increase in dye depth and an improvement in uniformity of dye acceptance.

The spin finish of the preceding Example was a finish emulsion (8%) consisting of the following components with from 0 to 6% benzyl alcohol added thereto:

| | |
|---|---|
| 77.3% | Butyl stearate |
| 6.5% | Dioctyl Sodium sulfo succinate |
| 4.9% | Polyethylene glycol (gr. mol. wgt. 600) monolaurate |
| 8.7% | Oleyl acid phosphate |
| 2.6% | KOH (56% solution prepared from flakes of 90 – 92% purity) |

The chip relative viscosity was measured in 90% formic acid with a 1% nylon 6 polymer solution. Using X-ray diffraction measurements made in transmission using Ni filtered Cu-K alpha radiation, the beta/alpha ratio was formed by taking the intensity of the alpha (002) meridional reflection and dividing it by the intensity of the (020/(220) (doublet) equatorial reflection. Both of these intensities were adjusted by subtraction of background scattering. All measurements of the beta-/alpha ratio were made on bulked yarns. However, this fact is not believed to be significant in that bulked yarns wherein no benzyl alcohol was used (see top line, Table II) failed to show a significant change in the beta/alpha ratio, i.e., bulking alone does not reduce the beta/alpha ratio to acceptable levels.

Carpet samples of yarn prepared as in the preceding Example were tufted and routinely dyed a commercial Avocado color using disperse dyes. These carpet samples dyed uniformly and evidenced fully acceptable dye depth.

In the practice of the present invention as set forth in the preceding representative example, the particular yarn spinning process selected to which said invention is applied is not critical. For example, this invention can be practiced with nylon 6 yarn having no twist, such as that found in spin draw wound yarn, and it can be applied to twisted yarn, such as spun draw twisted and spun wound draw wound yarn, the latter two involving two-stage drawing.

The finish (non-aqueous) composition utilized in the representative examples of this specification essentially comprise a lubricant, a viscosity stabilizer, an emulsifier, and an antistat, which also may function to some degree as a co-emulsifier; these components can be varied within the skill of the art and made into an aqueous emulsion concentration of from 5 to 20% in water. The specific emulsion utilized in the specification examples contain 8% by weight of the non-aqueous finish composition.

In the specific finish composition of the examples, the butyl stearate functions as a lubricant; the dioctyl sodium sulfosuccinate as a viscosity stabilizer; the polyethylene glycol (600 gram molecular weight) monolaurate as an emulsifier; and the oleyl acid phosphate/-potassium hydroxide components as antistat and to some degree as co-emulsifier.

In the dyeing of the drawn polyamide yarn of the preceding examples, routine disperse dyeing techniques were utilized. The dyes involved were mixtures of Disperse Blue 3, Disperse Red 55, and Disperse Yellow 3, said dyes being present in the dye bath in amounts of 0.15%, 0.25%, and 0.81%, respectively.

What is claimed is:

1. A process for the continuous spin-draw-winding of nylon 6 to produce yarn filaments having a mixed beta-/alpha crystallinity ratio comprising the steps of spinning continuous filaments of nylon 6, cooling said filaments in air, applying to the filaments an aqueous spin finish emulsion containing from about 3% to about 6% by weight of benzyl alcohol to enhance conversion of the beta hexagonal crystalline form to the alpha monoclinic crystalline form, and immediately thereafter continuously drawing said nylon 6 yarn filaments thereby imparting improved uniformity of dye acceptance to the drawn filaments.

2. The process of claim 1 wherein said finish contains from 5–20% by weight of one or more compositions selected from the group consisting of a lubricant, a viscosity stabilizer, an emulsifier and an antistat and the remainder is water.

3. Claim 1 wherein said filaments of nylon 6 are spun from chips having a relative viscosity of 2.4 and said filaments are drawn at a draw ratio of 3.5.

4. Claim 1 wherein said filaments are drawn without additional heating.

5. Claim 1 wherein said filaments are maintained at temperatures below 200° C during said drawing step.

6. Claim 1 wherein benzyl alcohol is the sole solvent.

7. Claim 1 wherein said finish consists essentially of about 3–6% benzyl alcohol, about 8% of a composition consisting of about 77% butyl stearate, about 6.5% dioctyl sodium sulfosuccinate, about 4.9% polyethylene glycol monolaurate, about 8.7% oleyl acid phosphate and about 2.6% potasium hydroxide and the remainder water.

* * * * *